US011896886B1

(12) United States Patent
Brown

(10) Patent No.: US 11,896,886 B1
(45) Date of Patent: Feb. 13, 2024

(54) GOLF PUTTING PRACTICE DEVICE

(71) Applicant: Bobby Brown, Shreveport, LA (US)

(72) Inventor: Bobby Brown, Shreveport, LA (US)

( * ) Notice: Subject to any disclaimer, the term of this patent is extended or adjusted under 35 U.S.C. 154(b) by 0 days.

(21) Appl. No.: 18/220,550

(22) Filed: Jul. 11, 2023

(51) Int. Cl.
*A63B 69/36* (2006.01)

(52) U.S. Cl.
CPC ..... *A63B 69/3688* (2013.01)

(58) Field of Classification Search
CPC ..... A63B 69/3688
USPC ..... 473/2, 150, 183, 195, 220, 280
See application file for complete search history.

(56) References Cited

U.S. PATENT DOCUMENTS 1,191,444 A 7/1916 Lott
2,656,720 A 10/1953 Sonnett
2,709,594 A * 5/1955 Brandell ..... A63B 57/405 273/129 R
3,134,934 A * 5/1964 Brandell ..... A63B 69/3676 335/278
3,265,940 A * 8/1966 Brandell ..... H01F 7/1607 335/278
3,740,054 A 6/1973 Arkin
3,796,434 A * 3/1974 Moss ..... A63B 57/405 273/DIG. 26
3,972,532 A 8/1976 Bradley
4,078,806 A * 3/1978 Brandell ..... A63B 57/405 473/183
4,249,739 A * 2/1981 Brandell ..... A63B 57/405 473/183
4,624,461 A 11/1986 Way
5,435,572 A * 7/1995 Covel ..... A63B 69/002 473/423
5,501,452 A 3/1996 Halvorson
6,213,887 B1 * 4/2001 Carney ..... A63B 63/00 473/220
2003/0027650 A1 * 2/2003 Tompert ..... A63D 15/006 473/2
2009/0176591 A1 7/2009 Kershaw

* cited by examiner

*Primary Examiner* — Nini F Legesse
(74) *Attorney, Agent, or Firm* — R. Keith Harrison

(57) ABSTRACT

A golf putting practice device may include a main wall. A ball bias assembly may be provided in the main wall. The ball bias assembly may include an assembly housing. A ball opening may be provided in the assembly housing. A practice golf ball may be provided in the assembly housing. The practice golf ball may be disposable in a pre-strike position in which the practice golf ball protrudes through the ball opening and a retracted strike position in which the practice golf ball is at least partially recessed in the ball opening. A ball return spring may normally bias the practice golf ball in the pre-strike position. At least one side wall may extend from the main wall. The side wall or walls may be operable to support the main wall in an upright position on the support surface.

20 Claims, 11 Drawing Sheets

GOLF PUTTING PRACTICE DEVICE

FIELD

Illustrative embodiments of the disclosure relate to golf practice aids. More particularly, illustrative embodiments of the disclosure relate to a golf putting practice device which can teach a user to associate feel and sound with proper contact between a golf putter and a golf ball.

SUMMARY

Illustrative embodiments of the disclosure are generally directed to a golf putting practice device which is configured for deployment on a support surface and can teach a user to associate feel and sound with proper contact between a golf putter and a golf ball. An illustrative embodiment of the golf putting practice device may include a main wall. A ball bias assembly may be provided in the main wall. The ball bias assembly may include an assembly housing. A ball opening may be provided in the assembly housing. A practice golf ball may be provided in the assembly housing. The practice golf ball may be disposable in a pre-strike position in which the practice golf ball protrudes through the ball opening and a retracted strike position in which the practice golf ball is at least partially recessed in the ball opening. A ball return spring disposed in the assembly housing may engage the practice golf ball. The ball return spring may normally bias the practice golf ball in the pre-strike position. At least one side wall may extend from the main wall. The side wall or walls may be operable to support the main wall in an upright position on the support surface.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
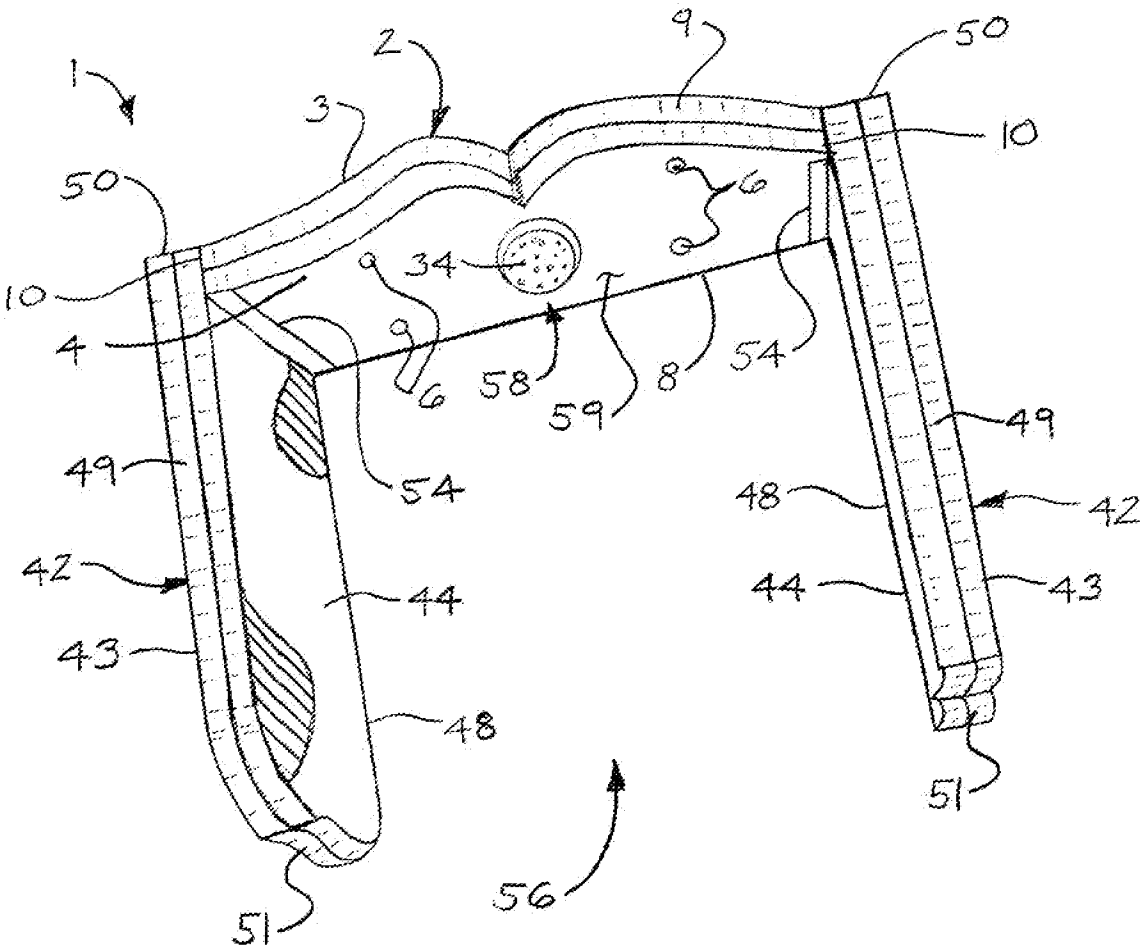
FIG. 1 is a front perspective view of an illustrative embodiment of the golf putting practice device.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "aft", "right", "fore", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Unless expressly or implicitly indicated otherwise, throughout the description and the appended claims, the terms "comprise", "comprising", "comprised of", "having", "including", and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition term "comprise" or "comprises" means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment.

Unless otherwise noted using precise or limiting terminology, all numbers which express quantities of ingredients throughout the specification and claims are to be understood as being approximations of the numerical value cited to express the quantities of those ingredients. As used throughout the specification and claims, the terms "about" and "generally" have the meaning reasonably ascribed to those terms by a person skilled in the art when used in conjunction with a stated numerical value or range, i.e., denoting from the exact stated value or range to somewhat more or somewhat less than the stated value or range, from a deviation of from 0% with respect to the stated value or range to up to and including 15% of the stated value or range in either direction.

Figure 8:
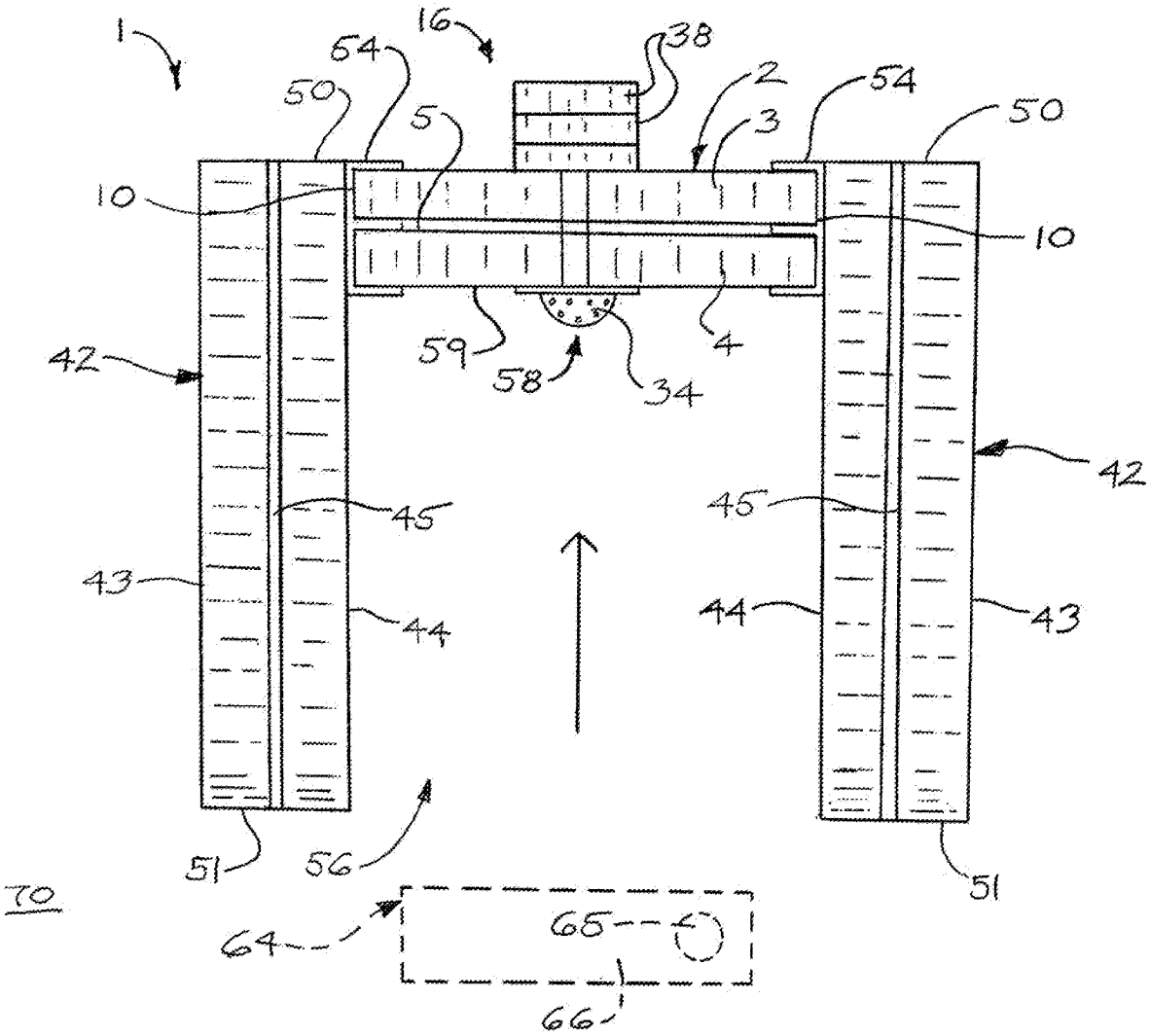
FIG. 8 is a top view of the illustrative golf putting practice device, preparatory to execution of a putting practice swing at the conclusion of which a golf putter head of a golf putter (illustrated in phantom) strikes a practice golf ball of the device in typical application of the device.
Figure 9:
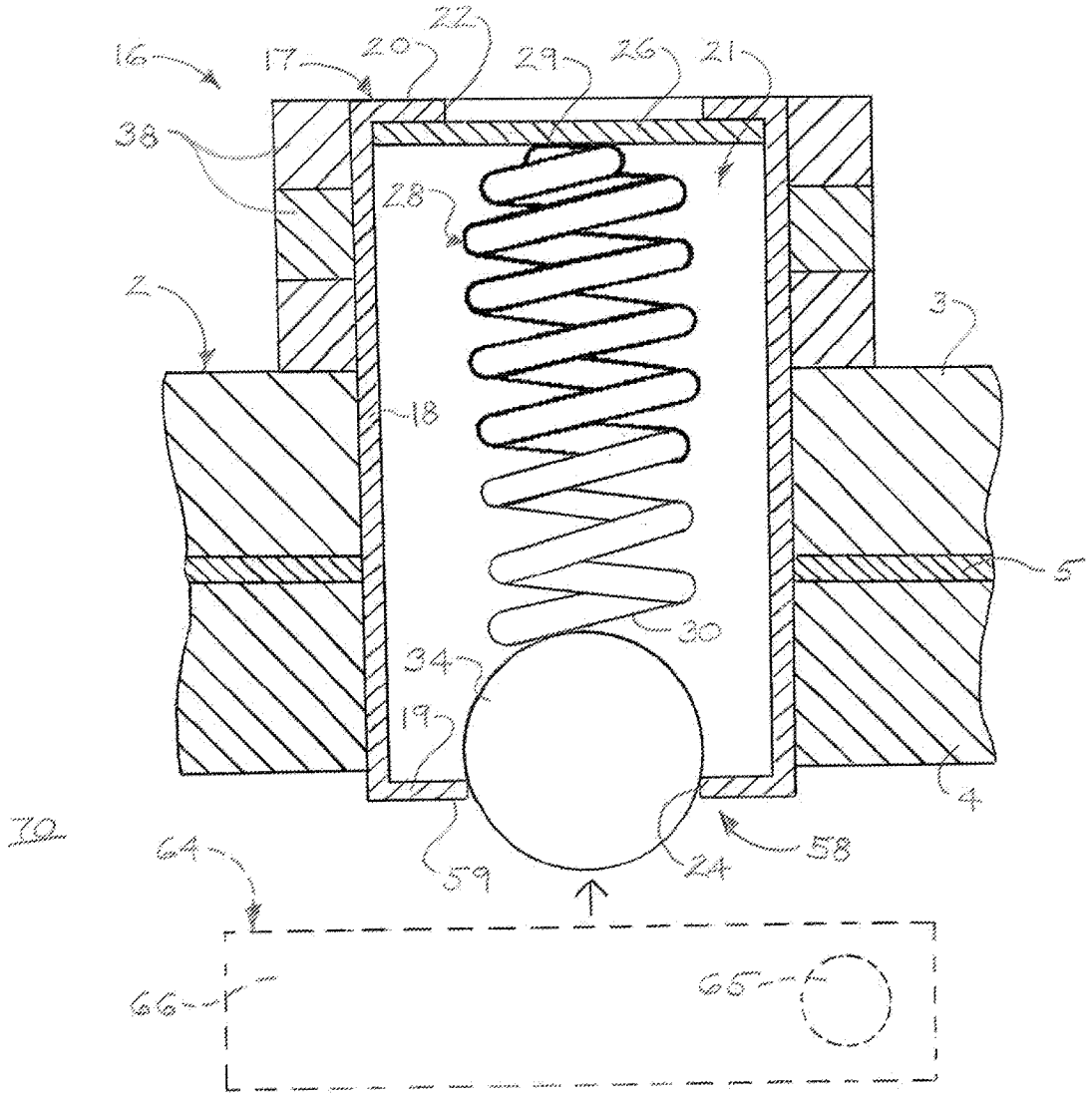
FIG. 9 is an enlarged sectional view of a typical ball bias assembly of the golf putting practice device illustrated in FIG. 8, with the practice golf ball in a pre-strike position immediately prior to contact of the golf putter head of the golf putter with the practice golf ball at the conclusion of the putting practice swing.
Figure 10:
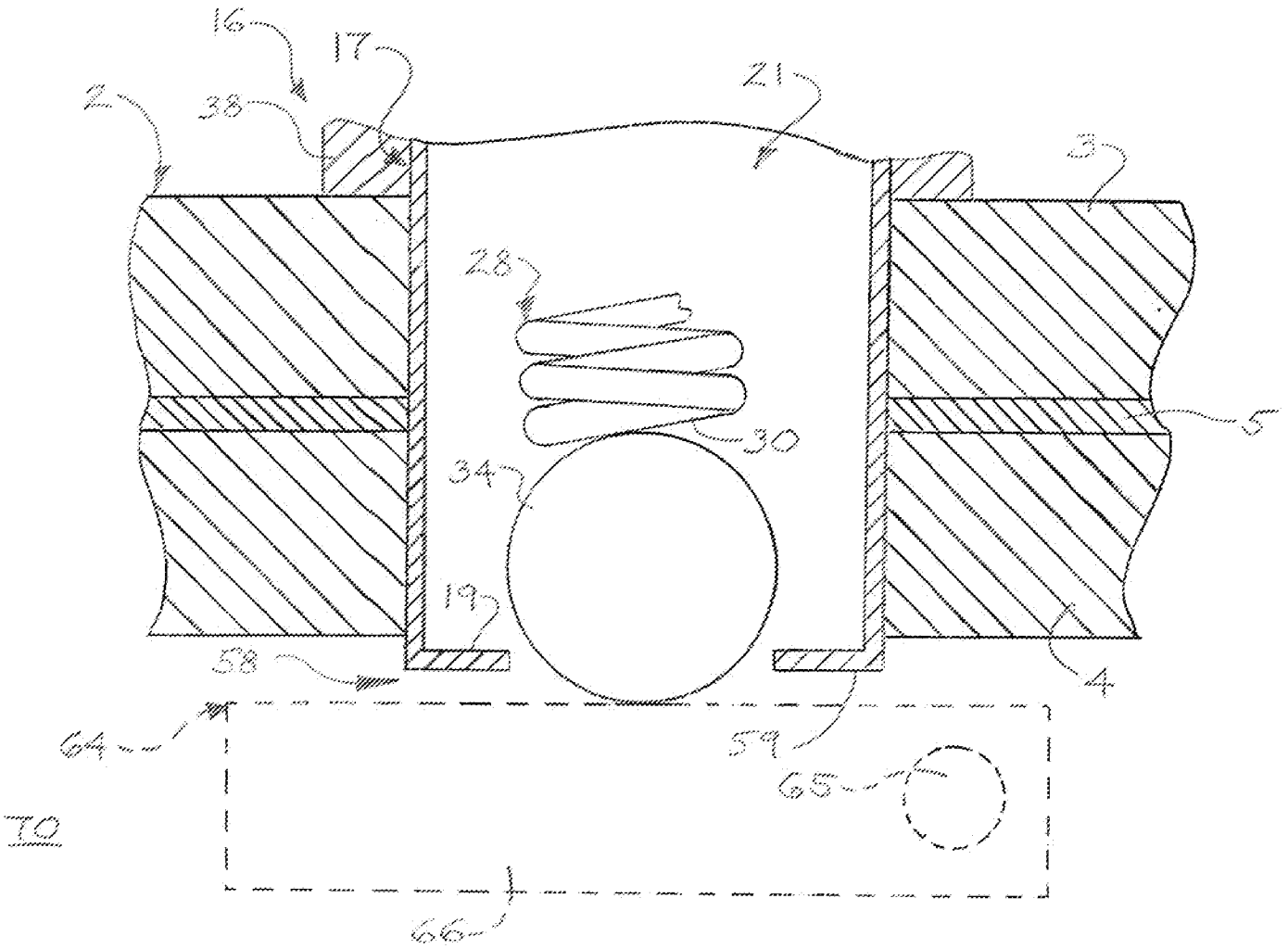
FIG. 10 is an enlarged sectional view of the ball bias assembly, after the golf putter head of the golf putter strikes the practice golf ball and deploys the practice golf ball from the pre-strike position to a strike position at the conclusion of the putting practice swing.

Referring initially to FIGS. 8-10 of the drawings, an illustrative embodiment of the golf putting practice device, hereinafter practice device, is generally indicated by reference number 1. The practice device 1 may include a practice golf ball 34. The practice golf ball 34 may be disposable in an extended, pre-strike position (FIGS. 8 and 9) and a retracted, strike position (FIG. 10). The practice golf ball 34 may normally be biased in the pre-strike position, typically as will be hereinafter described. In typical application, which will be hereinafter described, the practice device 1 may be deployed in place on a floor, the ground or other support surface 70. A user (not illustrated) who desires to practice putting of a golf ball using a golf putter 64 may grasp and swing the golf putter 64 to strike the practice golf ball 34 such that the golf ball 34 deploys from the pre-strike position to the strike position. The vibration which results from contact between the golf putter head 66 and the practice golf ball 34 and is transmitted through the golf putter shaft 65 to the handle (not illustrated) of the golf putter 64, as well as the sound which emanates from the practice golf ball 34, may mimic or simulate the feel and sound associated with contact between the golf putter head 66 and the practice golf ball 34 which would occur as if the golf putter head 66 were to contact a standard or conventional golf ball on a putting green. Accordingly, the practice device 1 may facilitate golf putting practice by enabling the user to associate feel and sound with proper contact between the golf putter head 66 on the golf putter 64 and a golf ball (not illustrated) on a putting green in a typical golf game.

Figure 6:
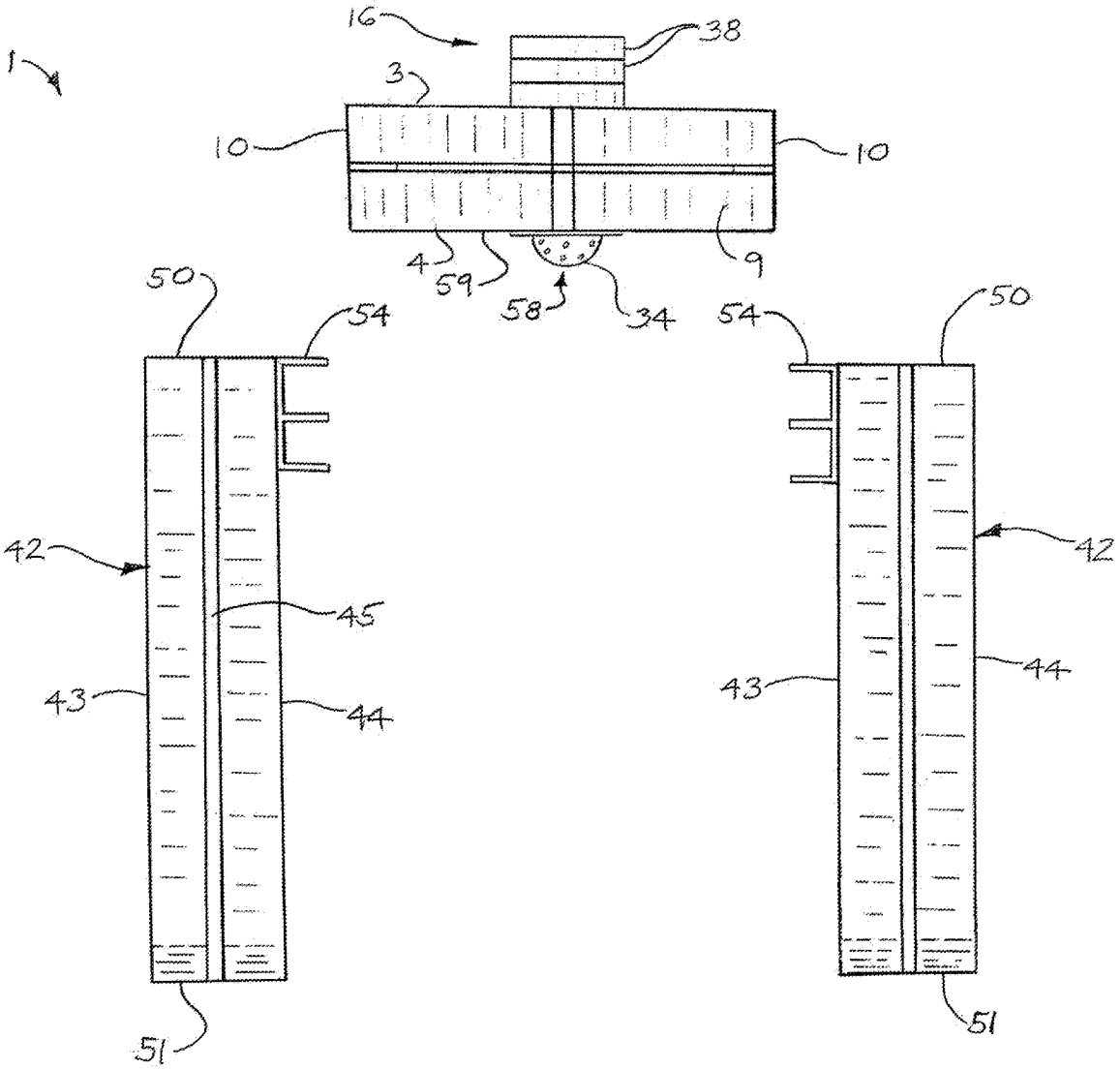
FIG. 6 is an exploded top view of the illustrative golf putting practice device in a disassembled state.
Figure 7:
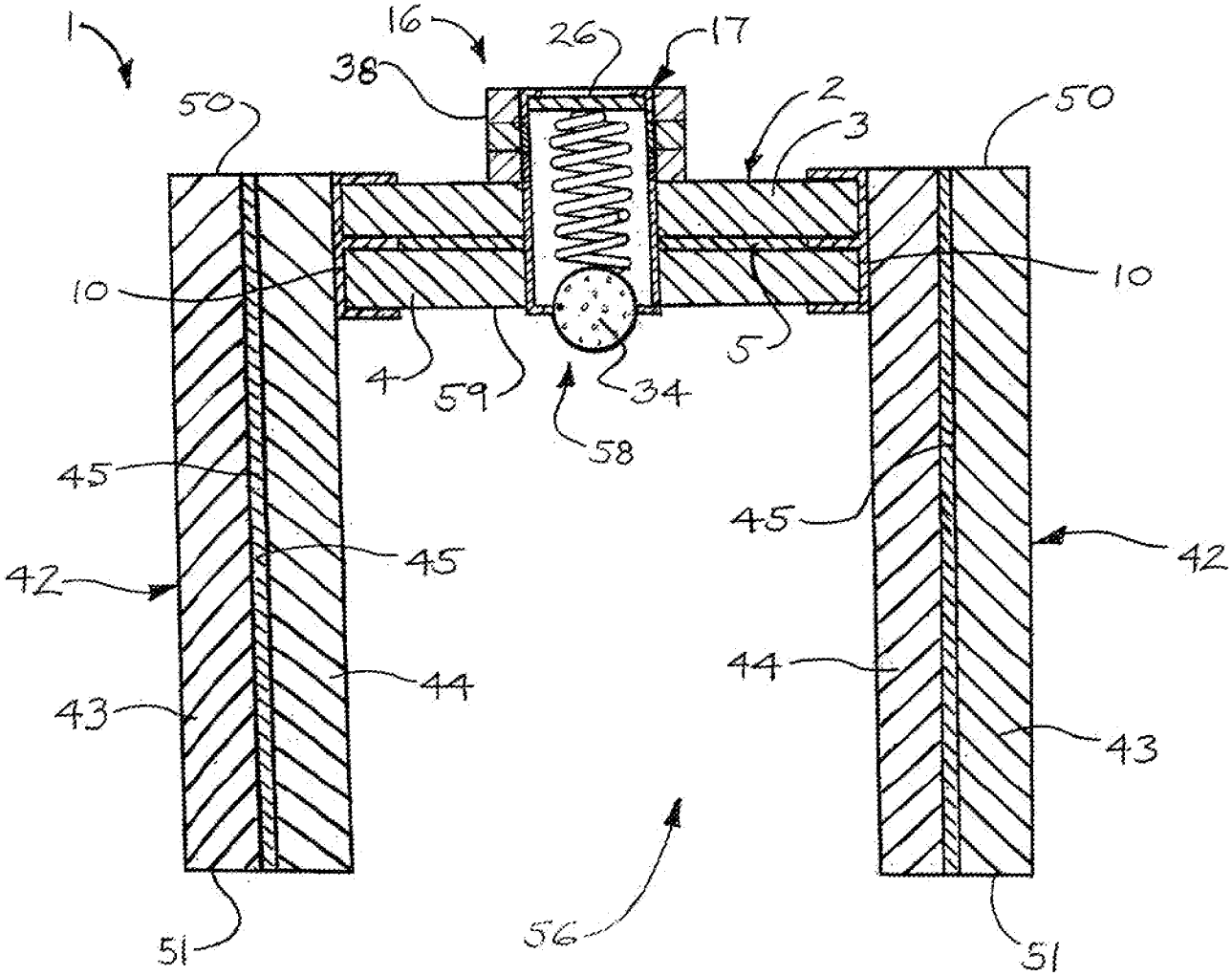
FIG. 7 is a sectional view, taken along section lines 7-7 in FIG. 5, of the illustrative golf putting practice device.

Referring next to FIGS. 1-12 of the drawings, the practice device 1 may include a main wall 2. A ball bias assembly 16 may be provided in the main wall 2. As illustrated in FIG. 7, the ball bias assembly 16 may include an assembly housing 17. The assembly housing 17 may traverse or extend through the thickness or depth of the main wall 2. The practice golf ball 34 may be disposed in the assembly housing 17. As illustrated in FIG. 9, a ball opening 24 may be provided in the assembly housing 17. The practice golf ball 34 may be partially disposed within the ball opening 24. In the pre-strike position illustrated in FIG. 9, the practice golf ball 34 may protrude from the assembly housing 17 through the ball opening 24. In the retracted strike position illustrated in FIG. 10, the practice golf ball 34 may be partially or completely recessed in the ball opening 24. A ball return spring 28 may be disposed in the assembly housing 17. The ball return spring 28 may engage the practice golf ball 34. The ball return spring 28 may normally bias the practice golf ball 34 in the pre-strike position and may be configured to return the practice golf ball 34 to the pre-strike position from the strike position.

In some embodiments, at least one shock absorbing element 38 may be provided on the assembly housing 17. The shock absorbing elements 38 may encircle a wall of the assembly housing 17 which protrudes beyond the rear surface of the main wall 2. The shock absorbing elements 38 may be fabricated of a foam or foam rubber material. Accordingly, the shock absorbing elements 38 may muffle the sound and/or absorb impact from the practice golf ball 34 as the practice golf ball 34 is struck by the golf putter head 66 of the golf putter 64 at the conclusion of the practice putting swing.

At least one side wall 42 may extend from the main wall 2. The side wall 42 may be operable to support the main wall 2 in an upright position on the support surface 70. In some embodiments, a pair of spaced-apart side walls 42 may extend from the main wall 2 in spaced-apart, parallel relationship to each other. A putting space 56 may be formed by and between the side walls 42. In the pre-strike position, the practice golf ball 34 may protrude into the putting space 56, as illustrated in FIG. 7.

The main wall 2 of the practice device 1 may include a ball strike interface 58 having a ball protrusion plane 59. The ball protrusion plane 59 may correspond to the planar front surface of the main wall 2. As illustrated in FIGS. 8 and 9, in the pre-strike position, the practice golf ball 34 may protrude through the ball opening 24 beyond the ball protrusion plane 59 of the ball strike interface 58. As illustrated in FIG. 10, in the strike position, the practice golf ball 34 may protrude a short distance beyond or may be substantially flush with the ball protrusion plane 59.

Figure 2:
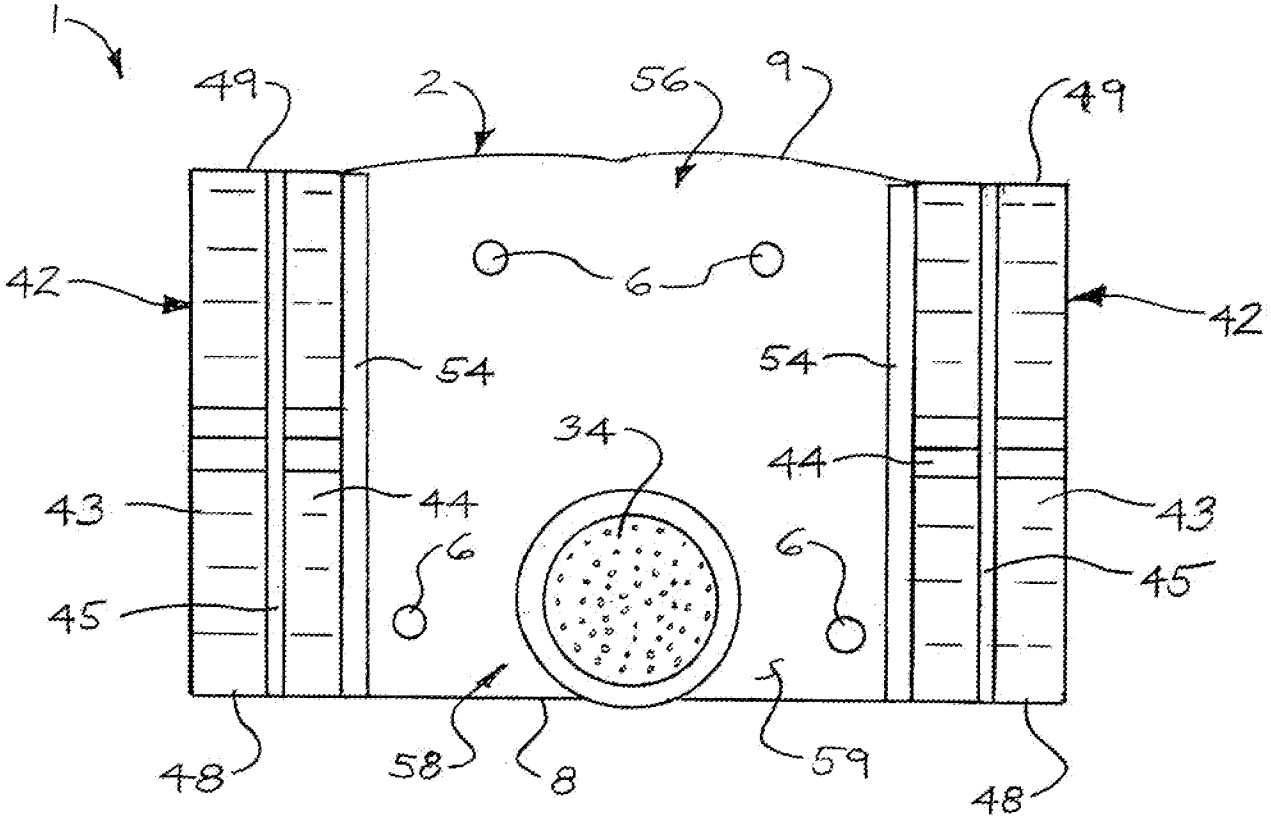
FIG. 2 is a front view of the illustrative golf putting practice device illustrated in FIG. 1.
Figure 3:
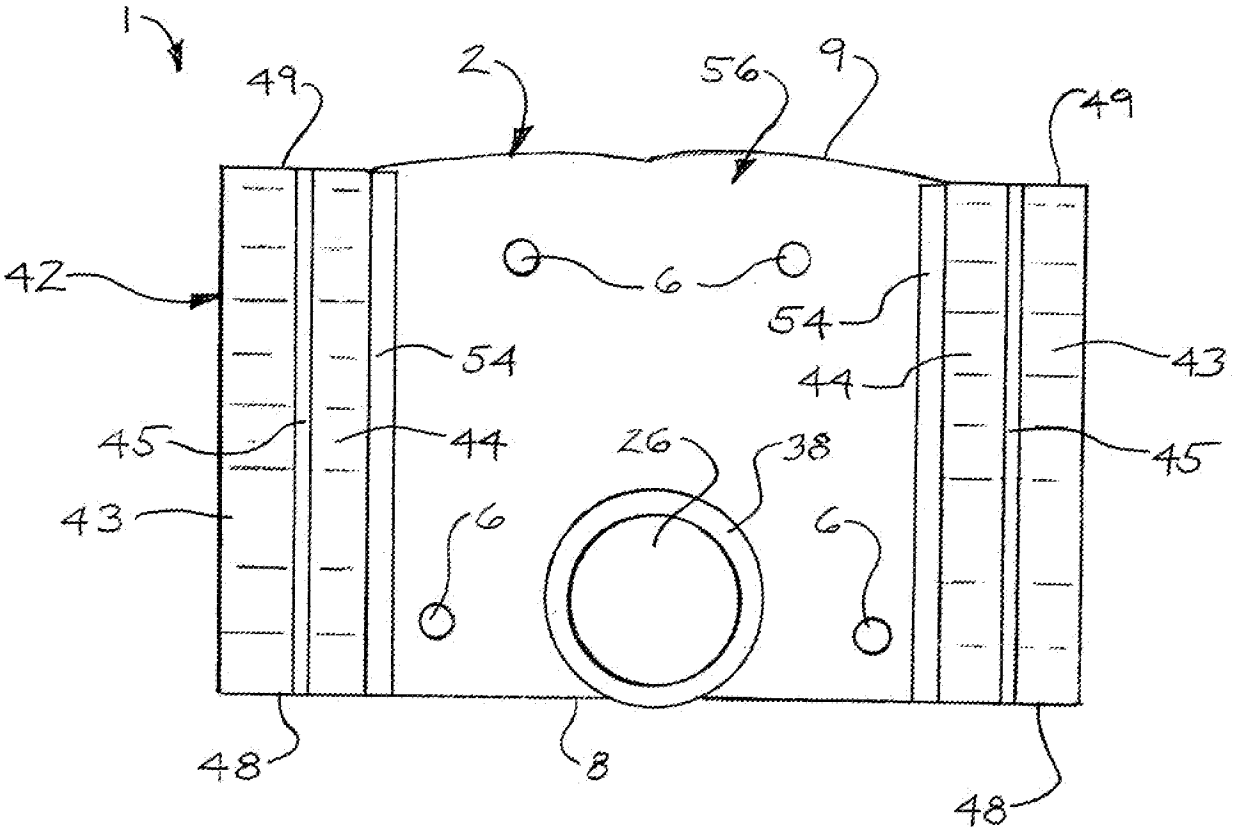
FIG. 3 is a rear view of the illustrative golf putting practice device.
Figure 4:
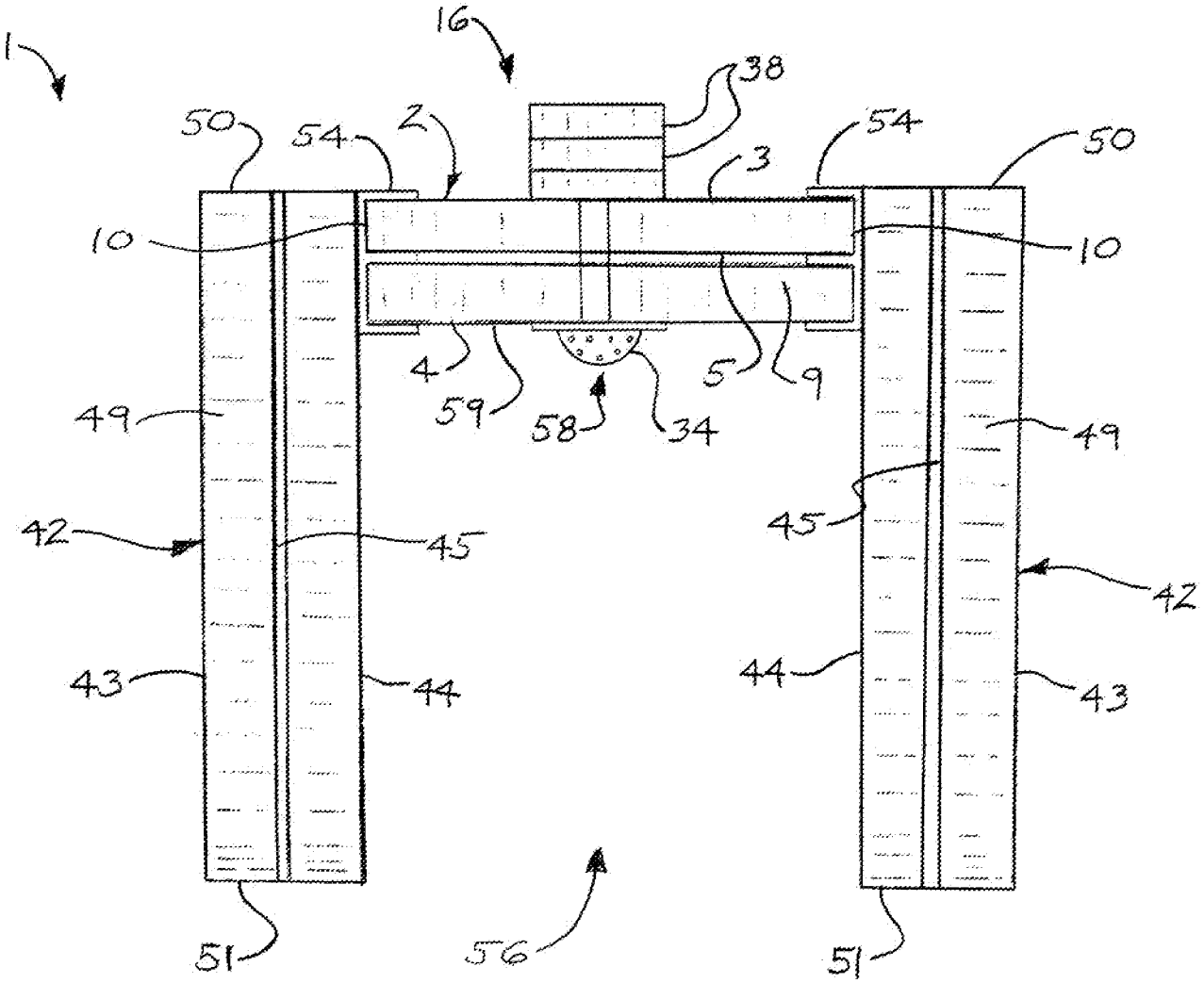
FIG. 4 is a top view of the illustrative golf putting practice device.
Figure 5:
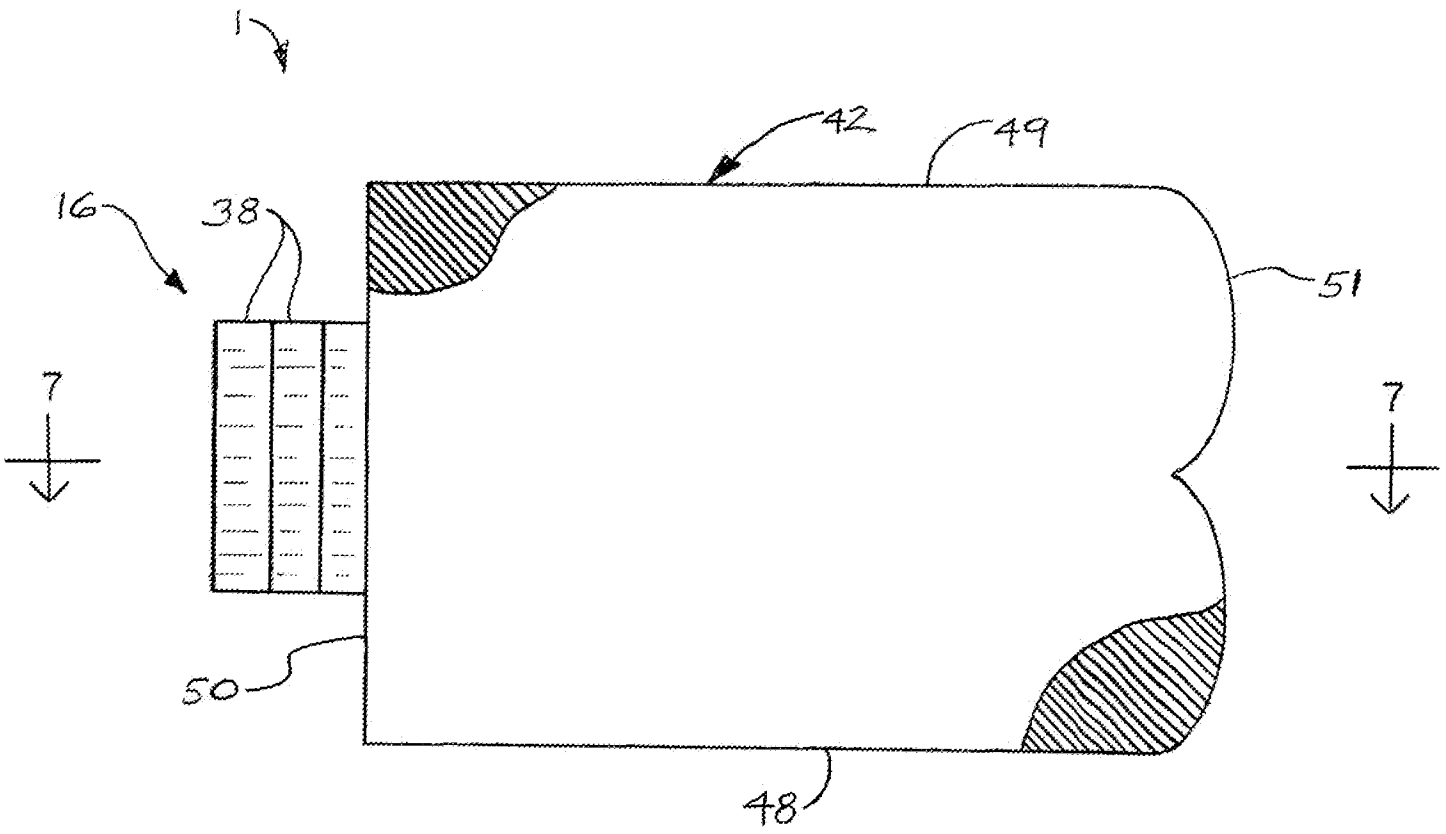
FIG. 5 is a right-side view of the illustrative golf putting practice device.

The main wall 2 of the practice device 1 may include at least one main wall panel 3, 4. For example and without limitation, in some embodiments, the main wall 2 may include a rear main wall panel 3 and a front main wall panel 4. In some embodiments, an inner panel layer 5 may be sandwiched between the rear main wall panel 3 and the front main panel wall 4. As illustrated in FIGS. 1-3, in some embodiments, wall fasteners 6 may attach the main wall panels 3, 4 to each other in the main wall 2.

Each side wall 42 of the practice device 1 may include at least one side wall panel 43, 44. For example and without limitation, in some embodiments, each side wall 42 may include an outer wall panel 43 and an inner wall panel 44. In some embodiments, an inner panel layer 45 may be sandwiched between the outer wall panel 43 and the inner wall panel 44.

In some embodiments, the main wall 2 and each side wall 42 may at least in part be fabricated of a foam or foam rubber material. Accordingly, the main wall 2 and the side walls 42 may muffle the sound and/or absorb impact energy from the practice golf ball 34 as the practice golf ball 34 is struck by the golf putter head 66 of the golf putter 64.

As illustrated in FIGS. 1-3, the main wall panel 2 of the practice device 1 may have a lower wall edge 8, an upper wall edge 9 and a pair of side wall edges 10. Each side wall 42 may have a lower wall edge 48, an upper wall edge 49, a front wall edge 50 and a rear wall edge 51. The front wall edge 50 of each side wall 42 may adjoin a corresponding side wall edge 10 of the main wall 2.

In some embodiments, each side wall 42 may be detachably attached to and selectively removable from the main wall 2 according to the knowledge of those skilled in the art. Accordingly, in some embodiments, at least one panel mount bracket 54 may attach each side wall 42 to the main wall 2. Each panel mount bracket 54 may be glued, fastened and/or otherwise attached to the corresponding side wall 42 typically at or adjacent to the front wall edge 50 thereof. In assembly of the practice device 1, each side wall edge 10 of the main wall 2 may be inserted and friction-fitted into the corresponding panel mount bracket 54. Other techniques suitable for attachment of the side walls 42 to the main wall 2 may include flanges and grooves, clips, screws and/or magnets, for example and without limitation.

The assembly housing 17 of the ball bias assembly 16 may have any size, design and shape suitable to accommodate the ball return spring 28. In some embodiments, the assembly housing 17 may have a discrete structure. Accordingly, as illustrated in FIG. 9, in some embodiments, the assembly housing 17 may include a housing sidewall 18. A housing front wall 19 and a housing rear wall 20 may extend from opposite ends of the housing sidewall 18. The ball opening 24 may extend through the housing front wall 19. The housing sidewall 18, the housing front wall 19 and the housing rear wall 20 may form a housing interior 21 which communicates with the ball opening 24. The housing interior 21 of the assembly housing 17 may accommodate the ball return spring 28 and the practice golf ball 34. In alternative embodiments, the assembly housing 17 may lack the discrete structure including the housing sidewall 18, the housing front wall 19 and the housing rear wall 20 and may simply include an opening or space within the main wall 2.

As further illustrated in FIG. 9, the ball return spring 28 may have a housing engaging end 29 and a ball engaging end 30. The housing engaging end 29 of the ball return spring 28 may engage the assembly housing 17. The ball engaging end 30 of the ball return spring 28 may engage the practice golf ball 34 such that the ball return spring 28 normally biases the practice golf ball 34 against the interior surface of the housing front wall 19 at the ball opening 24 in the pre-strike position of the practice golf ball 34. Accordingly, the ball return spring 28 may compress between the housing engaging end 29 and the ball engaging end 30 to absorb the impact energy of the golf putter head 66 of the golf putter 64 against the practice golf ball 34 as the practice golf ball 34 deploys from the pre-strike position in FIG. 9 to the strike position in FIG. 10. The ball return spring 28 may expand between the housing engaging end 29 and the ball engaging end 30 as the practice golf ball 34 deploys from the strike position back to the pre-strike position upon subsequent disengagement of the golf putter head 66 from the practice golf ball 34.

As illustrated in FIG. 9, in some embodiments, a rear housing opening 22 may extend through the housing rear wall 20 of the assembly housing 17. A spring backing layer 26 may span the rear housing opening 22. The housing engaging end 29 of the ball return spring 28 may engage the spring backing layer 26. Accordingly, the spring backing layer 26, disposed against the rear housing opening 22, may impart additional resiliency to the ball return spring 28 as the practice golf ball 34 deploys from the pre-strike position to the strike position. The spring backing layer 26 may have a resiliency or modulus of elasticity which is the same as or different from that of the housing rear wall 20 of the assembly housing 17 depending on the desired resiliency characteristics of the ball bias assembly 16. In some embodiments, the rear housing opening 22 and the spring backing layer 26 may be omitted and the housing engaging end 29 of the ball return spring 28 may directly engage the housing rear wall 20 of the assembly housing 17.

In typical application, the practice device 1 can be used to teach a user (not illustrated) to associate feel and sound with proper contact between a golf putter 64 and a standard or conventional golf ball as the golf ball is putted on a golf green. Accordingly, the practice device 1 may be deployed in place on the support surface 70 (FIGS. 8-10). The support surface 70 may be indoors or outdoors. For example and without limitation, in some applications, the support surface 70 may be an indoor carpeted surface. In other applications, the support surface 70 may be a grass surface outdoors. In some embodiments, a friction-resistant material (not illustrated) may be provided on the lower wall edge 8 of the main wall 2 and/or on the lower wall edge 48 of each side wall 42 to enhance stability of the practice device 1 on the support surface 70. In other applications, one or more stakes (not illustrated) may be used to secure and immobilize the practice device 1 on an outdoor support surface 70 according to the knowledge of those skilled in the art.

In some applications, the practice device 1 may normally be kept in a disassembled state for space-efficient storage and/or transport. In some embodiments, this may be accomplished by removing the side walls 42 from the main wall 2 at the respective panel mount brackets 54, as illustrated in FIG. 6. Reassembly of the practice device 1 for use may be accomplished typically by inserting the side wall edges 10 of the main wall 2 in the respective panel mount flanges 54.

After deployment of the practice device 1 in place on the support surface 70, the user may stand on the support surface 70 in front of the practice device 1. As the user grasps the handle on the golf putter shaft 65 of the golf putter 64, the user may execute a practice golf putting swing such that the golf putter head 66 rearwardly traverses the putting space 56 between the side walls 42 of the practice device 1 toward and then against the practice golf ball 34. As it strikes the practice golf ball 34, the impact energy from the forward momentum of the golf putter head 66 deploys the practice golf ball 34 from the pre-strike position illustrated in FIG. 9 to the strike position illustrated in FIG. 10. Accordingly, as it absorbs the impact energy, the ball return spring 28 may compress between the housing engaging end 29 and the ball engaging end 30. The shock absorbing element or elements 38 on the protruding rear wall of the housing sidewall 18 of the assembly housing 17 may additionally absorb impact energy as well as muffle impact sounds resulting from contact between the golf putter head 66 and the practice golf ball 34. The typically foam or foam rubber construction of the main wall 2 and the side walls 42 may additionally absorb impact energy and muffle the impact sounds.

As the golf putter head 66 contacts the practice golf ball 34, the resulting impact energy may be transmitted from the golf putter head 66 through the golf putter shaft 65 to the putter handle (not illustrated) on the golf putter shaft 65. Grasping the putter handle, the hands of the user may feel the impact energy as vibration. Accordingly, the vibration and sound which result from the impact energy formed by contact between the golf putter head 66 and the practice golf ball 34 may closely mimic or simulate the vibration or feel and sound which the user would otherwise experience upon initial contact between the putter head 66 and a standard or conventional golf ball on a putting green as the user puts the golf ball on the green.

Figure 11:
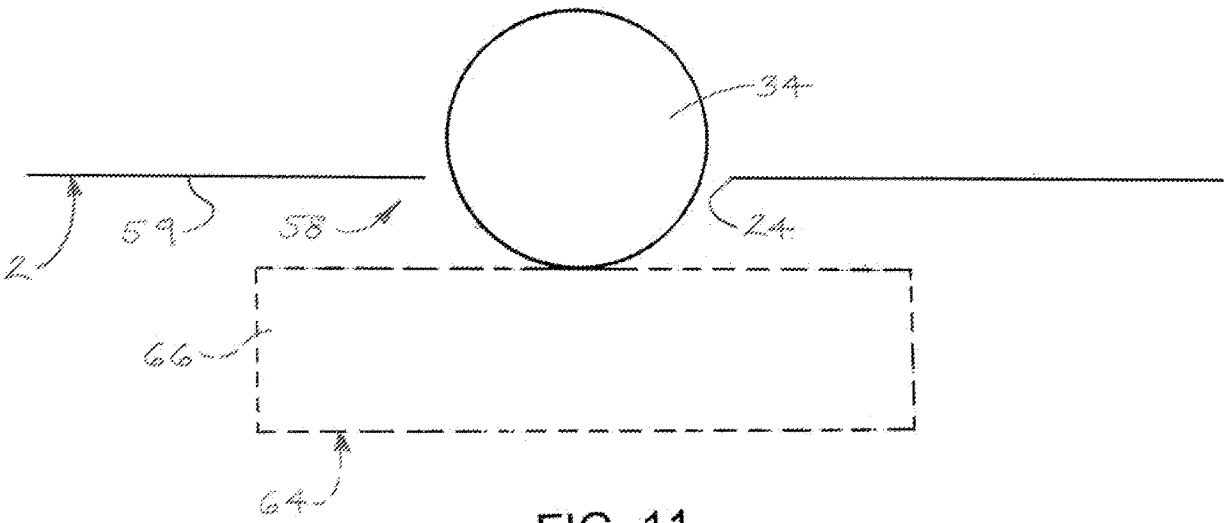
FIG. 11 is a top view of a golf putter head (illustrated in phantom) of a golf putter as it is oriented squarely with respect to the practice golf ball upon proper contact of the golf putter head with the practice golf ball at the conclusion of the putting practice swing.
Figure 12:
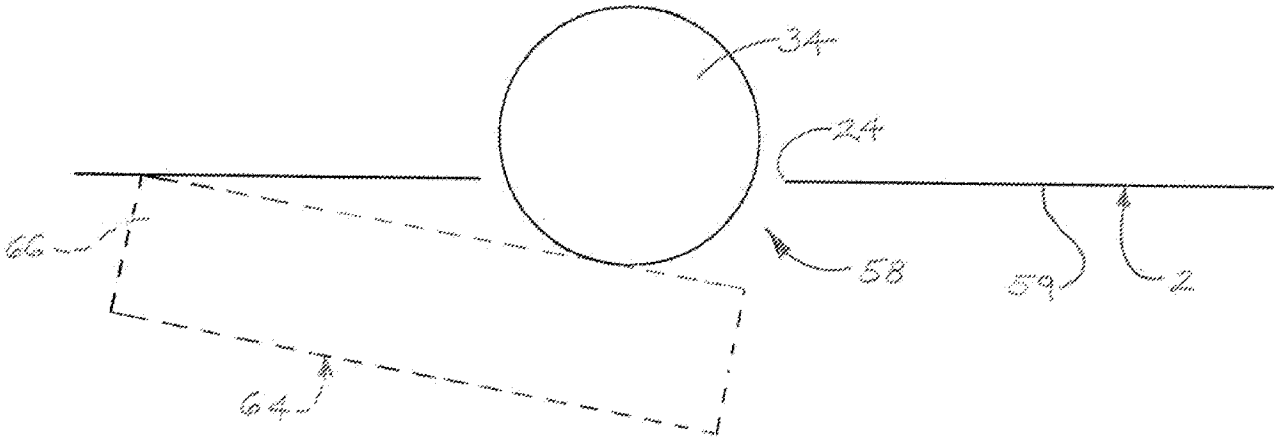
FIG. 12 is a top view of the golf putter head of the golf putter as it is improperly oriented with respect to the practice golf ball upon contact of the golf putter head with the practice golf ball at the conclusion of a putting practice swing.

As illustrated in FIG. 11, if the golf putter head 66 is square with the practice golf ball 34 (i.e., the longitudinal axis of the golf putter head 66 is parallel to the ball protrusion plane 59 of the ball strike interface 58) as it contacts the practice golf ball 34, then the impact feel and sound which are experienced by the user may correspond to the optimum orientation of the golf putter head 66 with respect to the golf ball which is necessary to achieve the desired putting trajectory of a golf ball on a golf green. In that case, the golf putter head 66 will not contact the main wall 2 of the practice device 1 at the conclusion of the swing. If the golf putter head 66 is not square with the practice golf ball 34 when it contacts the golf ball 34, on the other hand, as illustrated in FIG. 12, then the impact feel and sound experienced by the user will differ since the golf putter head 66 will at least partially contact the main wall 2 of the practice device 1 at the conclusion of the swing. The user may thus repeat the putting swing as many times as may be necessary to consistently strike the practice golf ball 34 squarely without contacting the main wall 2 of the practice device 1 at the conclusion of the swing.

While certain illustrative embodiments of the disclosure have been described above, it will be recognized and understood that various modifications can be made to the embodiments and the appended claims are intended to cover all such modifications which may fall within the spirit and scope of the disclosure.

I claim:

1. A golf putting practice device configured for deployment on a support surface, comprising:

a main wall;

a ball bias assembly in the main wall, the ball bias assembly comprising:

an assembly housing having a housing interior;

a ball opening in the assembly housing, the housing interior communicating with the ball opening;

a practice golf ball disposed for translational motion in the housing interior of the assembly housing, the practice golf ball disposable in a pre-strike position wherein the practice golf hall protrudes from the housing interior through the ball opening and a retracted strike position wherein the practice golf ball is at least partially recessed in the ball opening; and a ball return spring disposed in the assembly housing and engaging the practice golf ball, the ball return spring normally biasing the practice golf ball in the pre-strike position and operable to return the practice golf ball from the retracted strike position back to the re-strike position; and at least one side wall extending from the main wall, the at least one side wall operable to support the main wall in an upright position on the support surface.

2. The golf putting practice device of claim 1 wherein the at least one side wall comprises a pair of spaced-apart side walls and comprising a putting space formed by and between the pair of spaced-apart side walls.

3. The golf putting practice device of claim 1 wherein the main wall comprises at least one main wall panel.

4. The golf putting practice device of claim 1 wherein the at least one side wall comprises at least one side wall panel.

5. The golf putting practice device of claim 1 wherein the at least one side wall is selectively removable from the main wall.

6. The golf putting practice device of claim 1 wherein the assembly housing of the ball bias assembly comprises a housing sidewall and a housing front wall and a housing rear wall extending from the housing side wall, and the ball opening extends through the housing front wall.

7. The golf putting practice device of claim 1 further comprising at least one shock absorbing element on the assembly housing.

8. The golf putting practice device of claim 1 wherein each of the main wall and the at least one side wall comprises a foam material.

9. A golf putting practice device configured for deployment on a support surface, comprising:

a main wall having a ball strike interface with a ball protrusion plane;

a ball bias assembly in the main wall, the ball bias assembly comprising:

an assembly housing having a housing interior;

a ball opening in the assembly housing, the housing interior communicating with the ball opening;

a practice golf ball disposed for translational motion in the housing interior of the assembly housing, the practice golf ball disposable in a pre-strike position wherein the practice golf ball protrudes from the housing interior through the ball opening beyond the ball protrusion plane of the ball strike interface and a retracted strike position wherein the practice golf ball is at least partially recessed in the ball opening; and a ball return spring disposed in the assembly housing and engaging the practice golf ball, the ball return spring normally biasing the practice golf ball in the pre-strike position and operable to return the practice golf ball from the retracted strike position back to the pre-strike position; and at least one side wall extending from the main wall, the at least one side wall operable to support the main wall in an upright position on the support surface.

10. The golf putting practice device of claim 9 wherein the at least one side wall comprises a pair of spaced-apart side walls and comprising a putting space formed by and between the pair of spaced-apart side walls.

11. The golf putting practice device of claim 9 wherein the main wall comprises at least one main wall panel.

12. The golf putting practice device of claim 9 wherein the at least one side wall comprises at least one side wall panel.

13. The golf putting practice device of claim 9 wherein the at least one side wall is selectively removable from the main wall.

14. The golf putting practice device of claim 9 wherein the assembly housing of the ball bias assembly comprises a housing sidewall and a housing front wall and a housing rear wall extending from the housing side wall, and the ball opening extends through the housing front wall.

15. The golf putting practice device of claim 9 further comprising at least one shock absorbing element on the assembly housing.

16. The golf putting practice device of claim 9 wherein each of the main wall and the at least one side wall comprises a foam material.

17. A golf putting practice device configured for deployment on a support surface, comprising:

a main wall having a ball strike interface with a ball protrusion plane, the main wall comprising at least one main wall panel and having lower wall edge, an upper wall edge and a pair of side wall edges;

a ball bias assembly in the main wall, the ball bias assembly comprising:

an assembly housing having a housing interior;

a ball opening in the assembly housing, the housing interior communicating with the ball opening;

a practice golf ball disposed for translational motion in the housing interior of the assembly housing, the practice golf ball disposable in a pre-strike position wherein the practice golf ball protrudes from the housing interior through the ball opening beyond the ball protrusion plane of the ball strike interface and a retracted strike position wherein the practice golf ball is at least partially recessed in the ball opening;

a ball return spring disposed in the assembly housing and engaging the practice golf ball, the ball return spring normally biasing the practice golf ball in the pre-strike position and operable to return the practice golf ball from the retracted strike position back to the pre-strike position; and at least one shock absorbing element on the assembly housing;

a pair of spaced-apart side walls extending from the main wall, the pair of spaced-apart side walls operable to support the main wall in an upright position on the support surface, each of the pair of spaced-apart side walls having a lower wall edge, an upper wall edge, a front wall edge adjoining a corresponding one of the pair of side wall edges of the main wall, and a rear wall edge; and a putting space formed by and between the pair of spaced-apart side walls, the practice golf ball protruding into the putting space in the pre-strike position.

18. The golf putting practice device of claim 17 wherein each of the pair of spaced-apart side walls is selectively removable from the main wall.

19. The golf putting practice device of claim 18 further comprising at least one panel mount flange attaching each of the pair of spaced-apart side walls to the main wall.

20. The golf putting practice device of claim 17 wherein the assembly housing of the ball bias assembly comprises a housing sidewall and a housing front wall and a housing rear wall extending from the housing side wall, and the ball opening extends through the housing front wall.

* * * * *